US005690216A

United States Patent [19]

Liu

[11] Patent Number: 5,690,216

[45] Date of Patent: Nov. 25, 1997

[54] PENCIL BOX WITH A COPY HOLDER STRUCTURE

[76] Inventor: Pao-Ying Liu, Ta-Ying No. 80-2, Ta-Ying Tsun, Hsin-Shih Hsiang, Tainan Hsien, Taiwan

[21] Appl. No.: 762,063

[22] Filed: Dec. 9, 1996

[51] Int. Cl.[6] ..... B65D 51/00; B65D 85/28

[52] U.S. Cl. ..... 206/214; 206/224; 206/371; 206/45.28

[58] Field of Search ..... 206/45.28, 214, 206/224, 371, 745, 747, 748, 756, 759, 45.2, 45.23

[56] References Cited

U.S. PATENT DOCUMENTS 1,919,879 7/1933 Einson et al. ..... 206/745

3,954,314 5/1976 Crawford ..... 206/224

4,588,074 5/1986 Strong et al. ..... 206/45.2

FOREIGN PATENT DOCUMENTS 28566 4/1909 United Kingdom ..... 206/214

*Primary Examiner*—Paul T. Sewell

*Assistant Examiner*—Anthony Stashick

*Attorney, Agent, or Firm*—Varndell Legal Group

[57] ABSTRACT

A pencil box including a box body, a box cover hinged to the box body, two stands pivoted to the box cover at the back and adapted for supporting the box cover in a tilted open position, a bottom rack and a top rack respectively pivoted to the front side of the box cover and adapted for holding a reading object for example a book for reading, and two support arms bilaterally pivoted to the front side of the box cover and adapted for holding the book in the desired open status.

1 Claim, 4 Drawing Sheets

PENCIL BOX WITH A COPY HOLDER STRUCTURE

BACKGROUND OF THE INVENTION

The present invention relates to pencil boxes, and more particularly to such a pencil box which has collapsible stands and collapsible racks for supporting the box cover in a tilted open position and holding a reading object on the box cover for reading.

Conventional pencil boxes are specifically designed for holding pencils and small writing materials. These pencil boxes are less attractive to children because they provide only a single function for holding things. Nowadays, a variety of multipurpose pencil boxes have been disclosed, and have appeared on the market. These multipurpose pencil boxes greatly invited childrens interest when they appeared on the market. Further, when studying or doing homework, a child may need to use a rack or stand to hold a book in a reading position for reading. However, the use of such a rack or stand occupies much table space.

SUMMARY OF THE INVENTION

The present invention has been accomplished under the circumstances in view. It is the main object of the present invention to combine a book rack into a pencil box, so that the pencil box can be used as rack means to support a reading object for reading when the pencil box is opened. According to the present invention, the pencil box comprises a box body, a box cover hinged to the box body, two stands pivoted to the box cover at the back and adapted for supporting the box cover in a tilted open position, a bottom rack and a top rack respectively pivoted to the front side of the box cover and adapted for holding a reading object for reading, and two support arms bilaterally pivoted to the front side of the box cover and adapted for holding the book in the desired open status.

DETAILED DESCRIPTION OF THE PREFERRED EMBODIMENT

Figure 1:
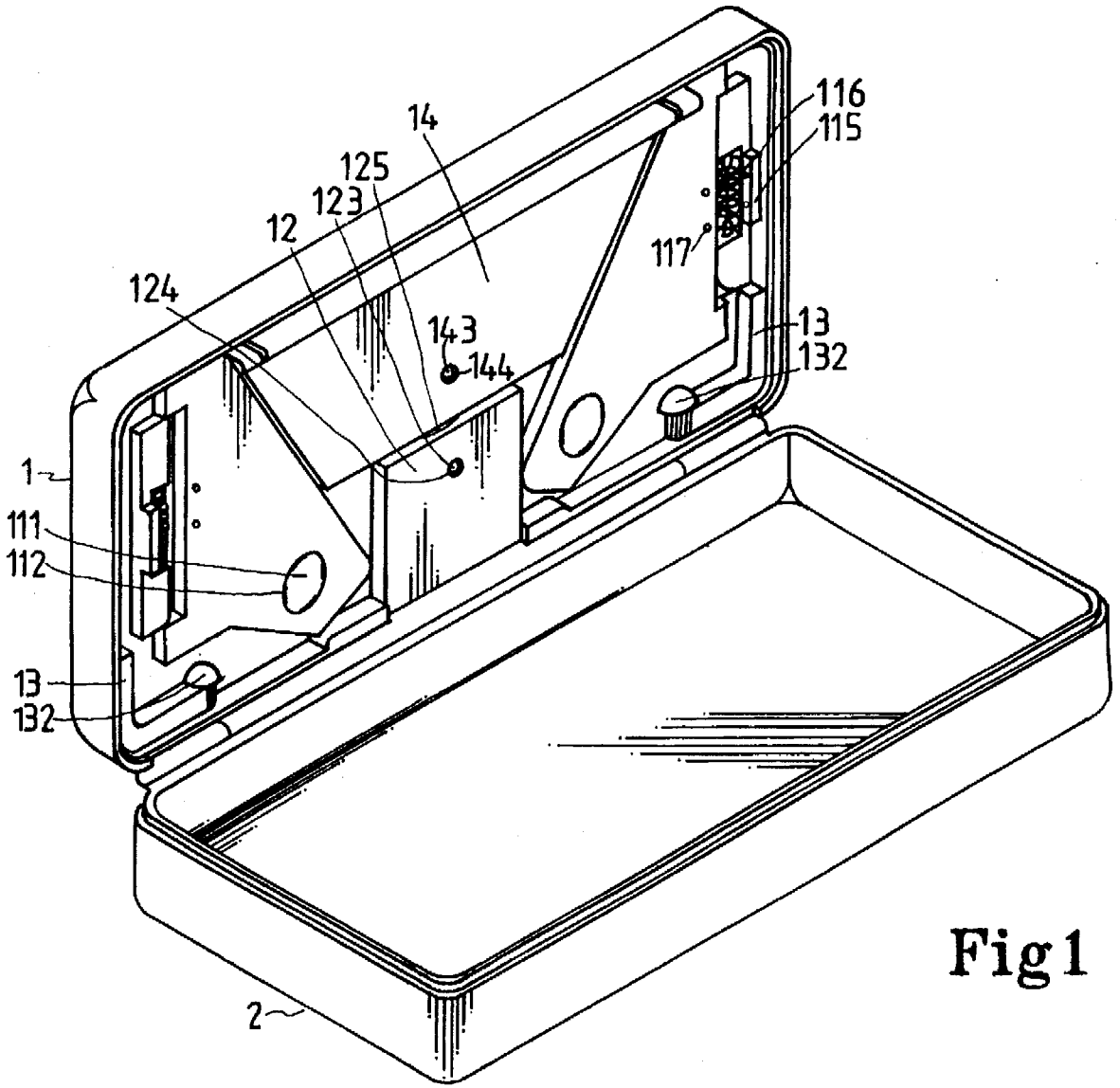
FIG. 1 is an elevational perspective view of a pencil box according to the present invention, showing the box cover opened.
Figure 2:
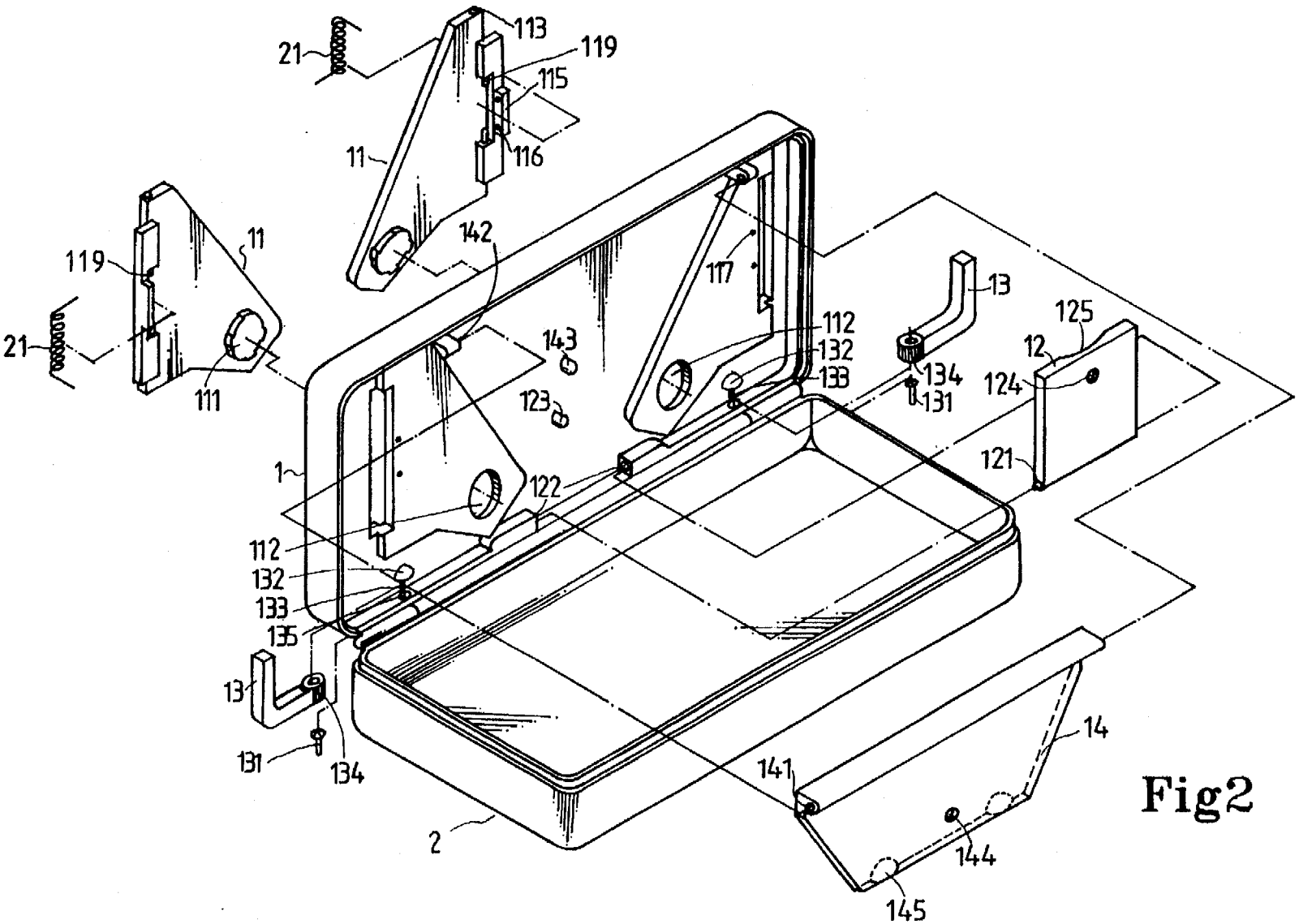
FIG. 2 is an exploded view of the pencil box shown in FIG. 1.
Figure 3:
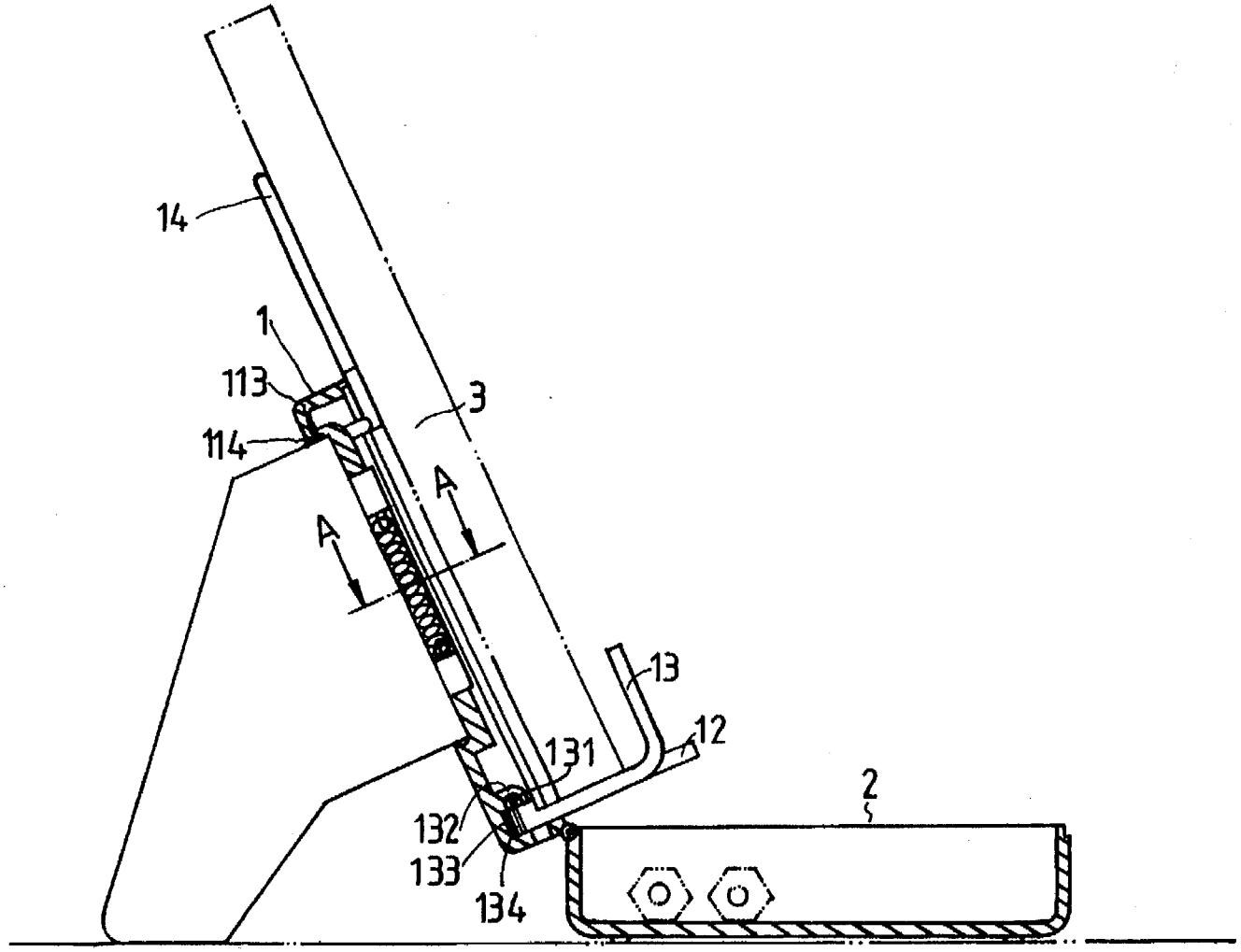
FIG. 3 is a side view in section of the present invention, showing the stands, the bottom rack, the top rack, and the support arms respectively extended out.

Referring to FIGS. 1, 2 and 3, a pencil box in accordance with the present invention is generally comprised of a box body 2, a box cover 1 hinged to the box body 2, two stands 11 respectively pivoted to the back side of the box cover 1 and adapted for supporting the box cover 1 in a tilted open position as shown in FIG. 3, a bottom rack 12 and two support arms 13 respectively pivoted to the front side of the box cover 1 at the bottom for holding a reading object 3 for example a book or the like, and a top rack 14 pivoted to the front side of the box cover 1 at the top for supporting the reading object 3. FIG. 3 shows the box cover 1 opened, the stands 11, the bottom rack 12, the support arms 13 and the top rack 14 extended out.

Figure 4:
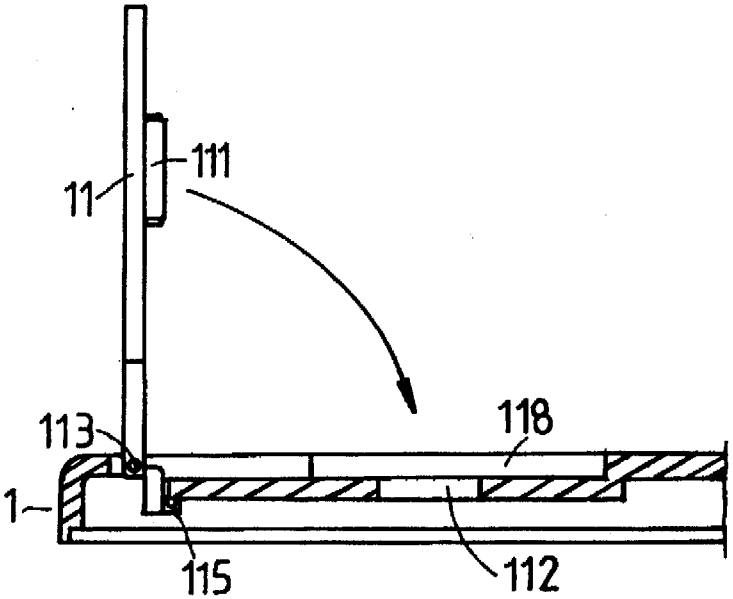
FIG. 4 is a sectional view of a part of the present invention, showing the stand moved relative to the box cover.

Referring to figures from 1 to 4 again, the box cover 1 comprises two back recesses 118 adapted for receiving the stands 11 in a collapsed manner, two pairs of pivot holes 114 respectively disposed in the back recesses 118, two locating holes 112 respectively made through the back recesses 118 remote from the pivot holes 114, a plurality of raised portions 117 alinged in each back recess 118, two bottom through holes 135, two cap members 132 respectively suspended above the bottom through holes 135, two projections 133 respectively raised from the inside wall and spaced between the cap members 132 and the bottom through holes 135, two axle housings 122 spaced at the bottom between the bottom through holes 135 and facing each other, a first locating rod 123 and a second locating rod 143 perpendicularly raised from the inside in the middle, and two lugs 142 raised from the inside at the top. Each of the stands 11 has a pair of pivot pins 113 longitudinally aligned at one end and respectively coupled to the pivot holes 114 in one back recess 118, a locating block 111 raised from one side remote from the pivot pins 113 and adapted for fitting into the locating hole 112 of the corresponding back recess 118 to secure the respective stand 11 in the collapsed position, two fixed spring bolt 119, a torsional spring 21 mounted on the fixed spring bolt 119 and having two opposite ends respectively stopped against the respective stand 11 and the box cover 11 to impart an outward pressure to the respective stand 11, and a locating plate 115 raised from one side between the pivot pins 113. The locating plate 115 has recessed portions 116. When the stands 11 are extended out of the back recesses 118, the recessed portions 116 are respectively forced into engagement with the raised portions 117, and therefore the stands 11 are maintained in the extended position (see also FIG. 4). The bottom rack 12 is a flat rack, having two pivot pins 121 respectively raised from two opposite lateral sides near the back and respectively coupled to the axle housings 122, a recess 125 at the front side in the middle through which the bottom rack 12 can be moved with the hand between the collapsed position closely attached to the inside wall of the box cover 1 and the extended position for holding the reading object 3, and a locating hole 124 near the recess 125. When the bottom rack 12 is collapsed and closely attached to the inside wall of the box cover 1, the locating hole 124 is forced into engagement with the first locating rod 123, and therefor the bottom rack 12 is retained in the collapsed position. The support arms 13 fit the corners of the box cover 1. Therefore, when the support arms 13 are collapsed, they are closely attached to the inside wall of the box cover 1 in two corners (see FIG. 1). The support arms 13 have a respective toothed eye end 134 pivotably coupled between the cap members 132 and the bottom through holes 135 by a respective split-head bolt 131, and engaged with the projections 133 (see FIG. 3). Because the toothed eye ends 134 of the support arms 13 are respectively engaged with the projections 133 of the box cover 1, the support arms 13 are firmly retained at the desired angle. The top rack 14 has two pivot pins 141 raised from both ends of the rear side and respectively pivoted to the lugs 142, a plurality of recesses 145 spaced along the front side remote from the pivot pins 141 for the holding of the hand to turn the top rack 14 between the collapsed position (see FIG. 1) and the extended position (see FIG. 3), and a locating hole 144 near the front side adapted for coupling to the second locating rod 143, for permitting the top rack 14 to be retained in the collapsed position.

Referring to FIGS. 1 and 4 again, when the stands 11 are turned inwards from the extended position to the collapsed position, the locating blocks 111 are respectively forced into engagement with the locating holes 112 of the box cover 1, to retain the stands 11 in the collapsed condition.

Figure 5:
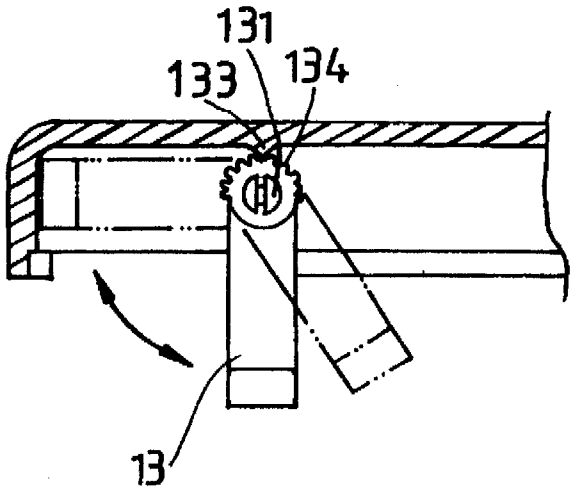
FIG. 5 is a sectional view of another part of the present invention, showing the support arm turned relative to the box cover, and the toothed eye end of the support arm meshed with the projection.

Referring to FIGS. 2, 3 and 5 again, the support arms 13 can be turned between the cap members 132 and the bottom through holes 135 to the desired angle, to hold a reading object 3 on the bottom rack 12. When adjusted, the support arms 13 are retained in position by means of the engagement between the projections 133 of the box cover 1 and the toothed eye ends 134 of the support arms 13.

While only one embodiment of the present invention has been shown and described, it will be understood that various modifications and changes could be made thereunto without departing from the spirit and scope of the invention disclosed.

I claim:

1. A pencil box comprising:

a box cover hinged to a box body, said box cover comprising a back side, a front side, a top side, a bottom side, two back recesses in said back side, two pairs of pivot holes respectively disposed in said back recesses, two locating holes respectively made through said back recesses remote from the pivot holes, a plurality of raised portions alinged in each back recess, two bottom through holes at said bottom side, two cap members respectively raised from said front side and suspended above said bottom through holes, two projections respectively raised from said front side and spaced between said cap members and said bottom through holes, two axle housings disposed at said bottom side between said bottom through holes and facing each other, a first locating rod and a second locating rod perpendicularly raised from said front side, and two lugs raised from said front side near said top side two stands respectively pivoted to the back side of said box cover and adapted for supporting said box cover in a tilted open position, each of said stands comprising a pair of pivot pins longitudinally aligned at one end and respectively coupled to the pivot holes in one back recess of said box cover, a locating block raised from one side and adapted for fitting into the locating hole of one back recess of said box cover to secure the respective stand in a collapsed position, two fixed spring bolt, a torsional spring mounted on the fixed spring bolt of the respective stand and having two opposite ends respectively stopped against the respective stand and said box cover to force the respective stand outwards from said box cover, and a locating plate raised from one side, said locating plate having a plurality of recessed portions which are forced into engagement with the raised portions in one back recess of said box cover when the respective stand is turned outwards from the back side of said box cover; a flat bottom rack pivoted to the axle housings of said box cover and adapted for holding a reading object when said box cover is opened and supported on said stands, said bottom rack comprising two pivot pins bilaterally raised from a back side thereof and respectively coupled to the axle housings of said box cover, a front recess for the holding of the hand, and a locating hole adapted for coupling to the first locating rod of said box cover to hold said bottom rack in a collapsed position closely attached to the front side of said box cover two support arms bilaterally pivoted to the front side of said box cover and adapted for holding the reading object on said bottom rack, said support arms comprising a respective toothed eye end pivotably coupled between the cap members and bottom through holes of said box cover by a respective split-head bolt, and engaged with the projections of said box cover; and a top rack pivoted to the lugs of said box cover and adapted for supporting the reading object on said bottom rack, said top rack comprising two pivot pins bilaterally raised from a rear side thereof and respectively pivoted to the lugs of said box cover, a plurality of recesses spaced along a front side thereof for the holding of the hand, and a locating hole disposed near the front adapted for coupling to the second locating rod of said box cover, for permitting said top rack to be retained in a collapsed position closely attached to the front side of said box cover.

* * * * *